US006978498B2

(12) United States Patent
Gavela Vazquez

(10) Patent No.: US 6,978,498 B2
(45) Date of Patent: Dec. 27, 2005

(54) WOODEN BED FRAME FOR SUPPORTING A MATTRESS

(76) Inventor: Juan Jose Gavela Vazquez, Ctra. Zamans 190,36310, Vigo Pontevedra (ES)

( * ) Notice: Subject to any disclaimer, the term of this patent is extended or adjusted under 35 U.S.C. 154(b) by 600 days.

(21) Appl. No.: 09/459,182

(22) Filed: Dec. 7, 1999

(65) Prior Publication Data

US 2005/0039258 A1 Feb. 24, 2005

(51) Int. Cl.[7] ..... A47C 19/00; A47C 23/06
(52) U.S. Cl. ..... 5/400; 5/236.1
(58) Field of Search ..... 5/400, 678, 679, 5/200.1, 236.1, 238

(56) References Cited

U.S. PATENT DOCUMENTS 705,384 A * 7/1902 Cooper ..... 5/238
4,535,494 A * 8/1985 Diamonstein ..... 5/400
4,613,999 A * 9/1986 Franco et al. ..... 5/400
4,788,727 A * 12/1988 Liu ..... 5/400
5,099,529 A * 3/1992 Anderson ..... 5/400
5,564,140 A * 10/1996 Shoenhair et al. ..... 5/400
5,701,653 A * 12/1997 Rupe ..... 5/400

FOREIGN PATENT DOCUMENTS

FR 2547185 * 12/1984 ..... 5/400

* cited by examiner

*Primary Examiner*—Alexander Grosz

(57) ABSTRACT

A rectangular horizontal bed frame includes a bottom wall that defines an open-topped enclosed space that contains longitudinal and transverse horizontal support slats arranged in a lattice relationship to support a bed mattress. The arrangement of the support slats eliminates the need for springs to support the mattress and creates a plurality of internal air chambers, thereby providing insulation within the apparatus. The horizontal support slats may be interchanged with various other supports to create a desired contour of the upper surface of the apparatus in order to effect the position of the accompanying mattress.

12 Claims, 9 Drawing Sheets

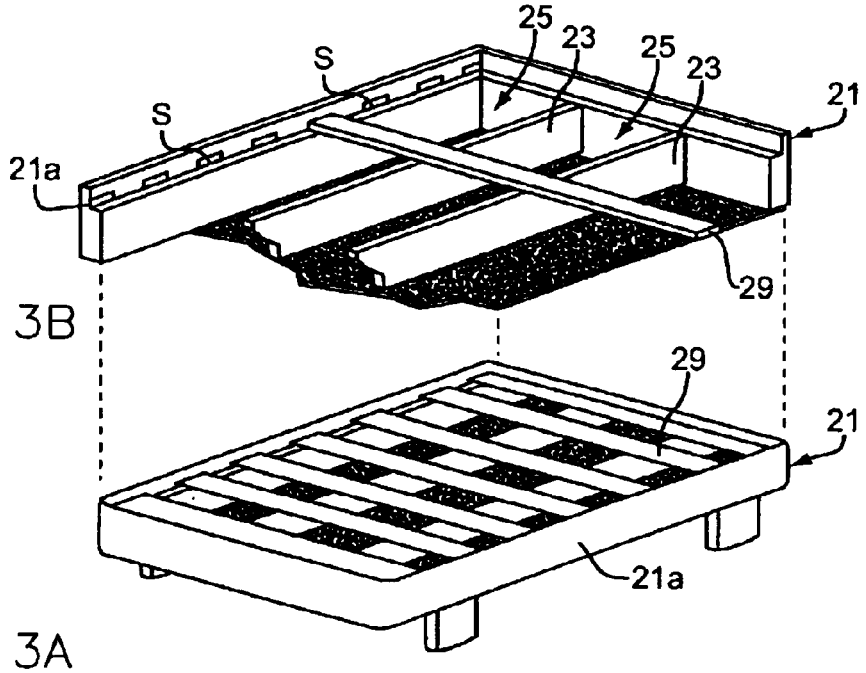
FIG. 3B
FIG. 3A
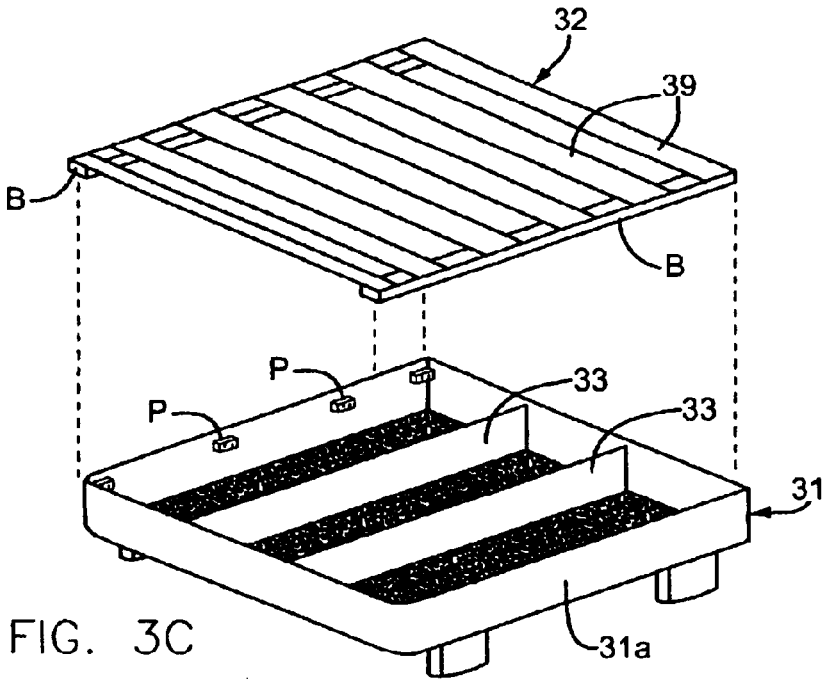
FIG. 3C

WOODEN BED FRAME FOR SUPPORTING A MATTRESS

FIELD

This invention relates to a bed frame for supporting a mattress, including a rectangular horizontal frame, a planar bottom wall closing the bottom of said frame to define an enclosed space, and a lattice structure dividing the enclosed space into a plurality of insulating air chambers. The lattice structure includes a plurality of parallel horizontally-spaced vertically-oriented support slats, and a plurality of parallel horizontally-spaced horizontally-oriented cross slats supported intermediate their ends by said support slats. The free ends of the cross slats are supported by the adjacent frame walls, respectively.

BACKGROUND

It has been proposed in the prior art to provide traditional wooden cabinet-type bed frames, either assembled or disassembled, for supporting the bed springs that in turn support a conventional bed mattress. It has also been proposed to provide a rigid metal frame that supports a wooden lattice which supports the mattress. The use of synthetic plastic materials has been proposed for use in frames that are designed to support the mattress. In the case of a day bed, there is no wooden lattice, but rather a frame is provided that is generally covered with cloth and includes a base adjacent the floor. Also, it has been proposed to provide a metal framework that is covered with cloth and has the shape of a box-like frame for supporting the bed springs.

SUMMARY

A primary object of the present invention is to provide a bed frame for supporting a mattress, including a horizontal rectangular frame having opposed pairs of side and end walls, a bottom wall closing the bottom of said frame to define an open-topped enclosed space, and lattice means dividing said enclosed space into a plurality of insulating air chambers, said lattice means including a plurality of parallel spaced horizontal vertically-oriented support slats extending parallel with a first pair of said frame walls, and a plurality of parallel spaced horizontally-oriented cross slats extending horizontally transversely above said support slats, the intermediate portions of said cross slats being supported by said support slats, and the ends of said cross slats being supported by the second pair of frame walls, respectively. Preferably all of the components of the frame are formed of wood.

In one embodiment, the support slats extend longitudinally of the frame, with the cross slats extending transversely of the frame. In a second embodiment, the support slats extend transversely of the frame, and the cross slats extend longitudinally of the frame.

According to a more specific object of the invention, the slate end support means for supporting the ends of the cross slats comprise slots contained in the adjacent faces of the second pair of frame walls, which slots receive the corresponding ends of the cross slats, respectively. In another embodiment, the ends of the cross slats are supported by projections that extend inwardly from the adjacent faces of said second pair of frame walls. According to one modification, a pair of support bars are connected transversely beneath the ends of the cross slats, respectively, which support bars are in turn supported by the inwardly directed support projections. In one embodiment, the cross slats are supported adjacent the upper edge of the frame, and in a second embodiment, the cross slats are spaced downwardly from the upper edge of the frame, whereby the lower portion of a mattress mounted thereon is recessed within the upper portion of the frame.

According to another object of the invention, the cross slats may have different thicknesses, so that certain portions of the mattress have higher elevations than the other portions.

A further object of the invention is to provide a bed frame wherein externally rounded corner sections are connected between the side and end walls of the frame. Preferably, the frame side and end walls are connected with the corner sections by mortise and tenon joints.

Another object of the invention is to provide metal bracket means for connecting the wooden frame with a wooden headboard.

The invention relates to a support for a bed mattress which eliminates the need for springs, can be manually configured to provide for various mattress contour configurations, and has a plurality of internal insulation areas. The configuration of longitudinal support members which interact with perpendicular support members to form a supportive base that is connectedly attached to a base panel and a peripheral frame provides sufficient support to the mattress to eliminate the need for supportive springs. Additionally, various horizontal support members can be interchanged to thereby create different contours for the overall support surface which meets the mattress. This interchange feature allows for customization of the surface to create a desired position of the mattress. Further, the internal compartments of the frame structure are created between the base panel, longitudinal supports, horizontal supports, and accompanying mattress which thereby act as an insulation means of the overall structure.

BRIEF DESCRIPTION OF THE DRAWINGS

Other objects and advantages of the invention will become apparent from a study of the following specification, when viewed in light of the accompanying drawings, in which:

FIG. 3A is a perspective view, and FIG. 3B is a detailed view with certain parts removed, of a first modification of the slot end support means of FIGS. 1 and 2, and FIG. 3C is an exploded view of a second modification of the slot support means;

DETAILED DESCRIPTION

Figure 1A:
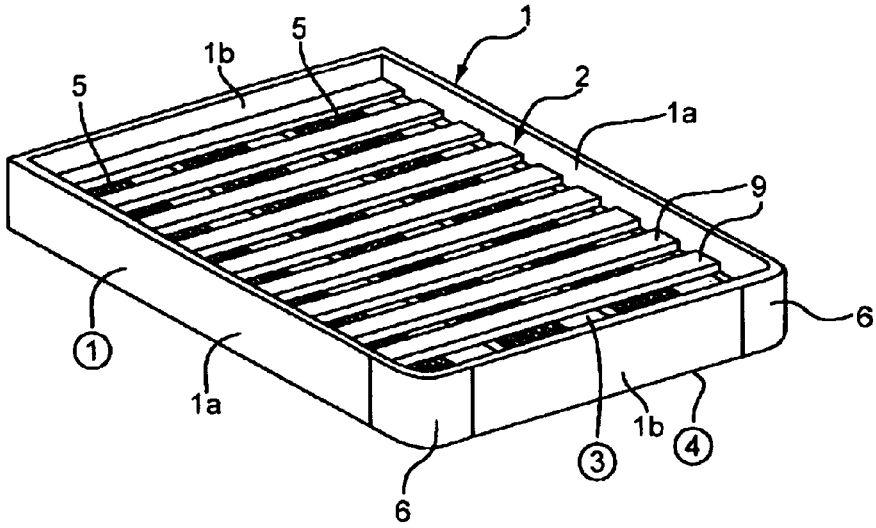
FIG. 1A is a front perspective view of the bed frame of the present invention.

In FIG. 1A, the horizontal rectangular bed frame 1 includes a pair of parallel longitudinal side walls 1*a* and a pair of opposed transverse end walls 1*b*. The bottom of the rectangular frame 1 is closed by a bottom wall 4, thereby to define a open-topped enclosed space in which is mounted a lattice 2 for supporting the bed mattress (not shown). The lattice 2 comprises a plurality of parallel spaced longitudinally extending support slats 3 that are vertically oriented within the enclosed space adjacent the bottom wall 4. Extending transversely above the support slats 3 are a plurality of horizontal parallel spaced cross slats 9. As will be described in greater detail below, the support slats and cross slats define a plurality of insulating air chambers 5 within the enclosed space. The side walls 1*a* and the end 1*b* of the frame are connected by comer sections 6, as will be described below.

Figure 1B:
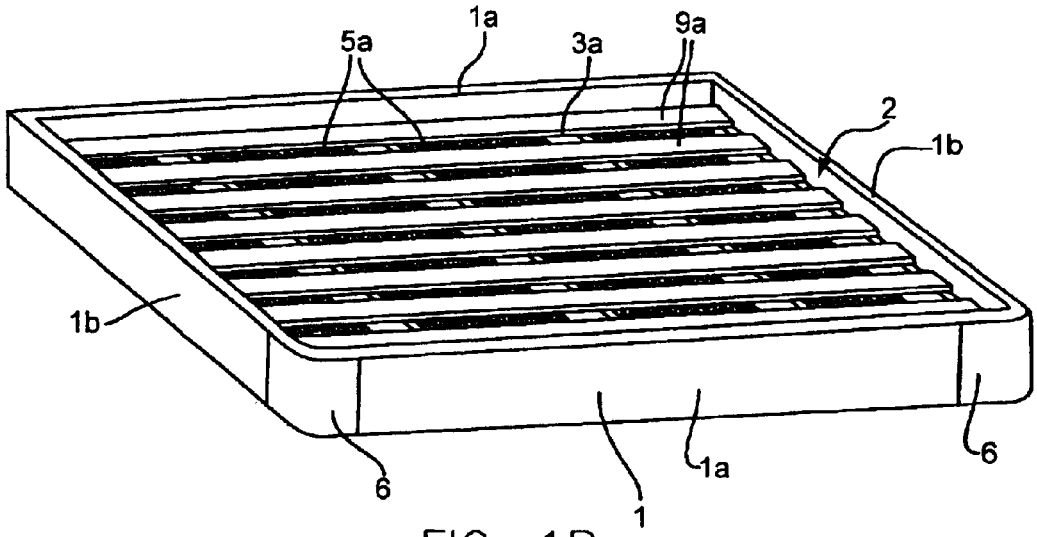
FIG. 1B is a modification of the embodiment of FIG. 1A.

In the modification of FIG. 1B, the support slats 3A of the lattice 2A extend transversely of the bed frame 1, and the cross slats 9A extend longitudinally of the bed frame, thereby to define within the enclosed space a plurality of air insulation chambers 5A.

Figure 2A:
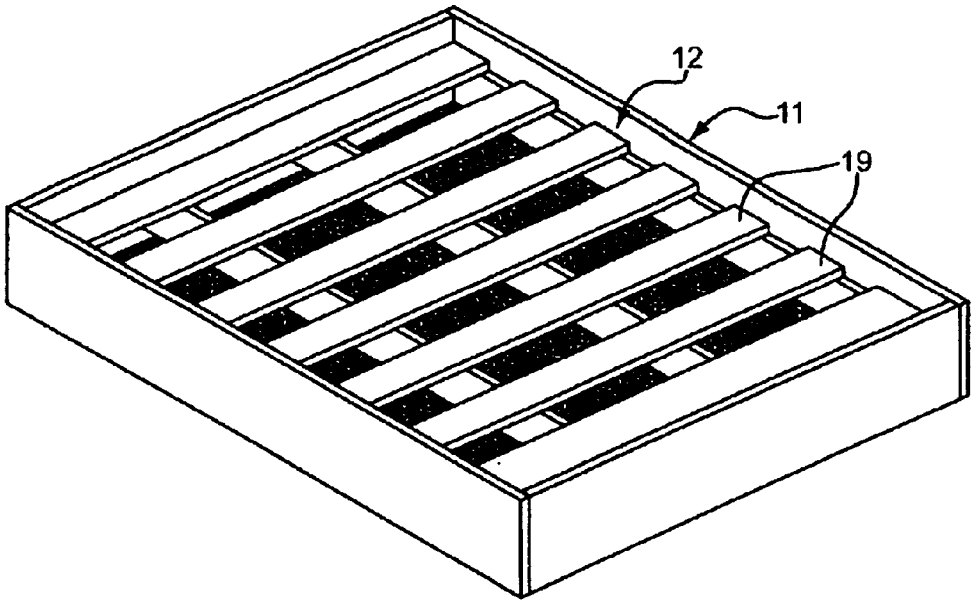
FIGS. 2A and 2B are front perspective views of bed frame embodiments in which the cross slats of the lattice are space downwardly from, and are adjacent the upper edge of, the frame, respectively.
Figure 2B:
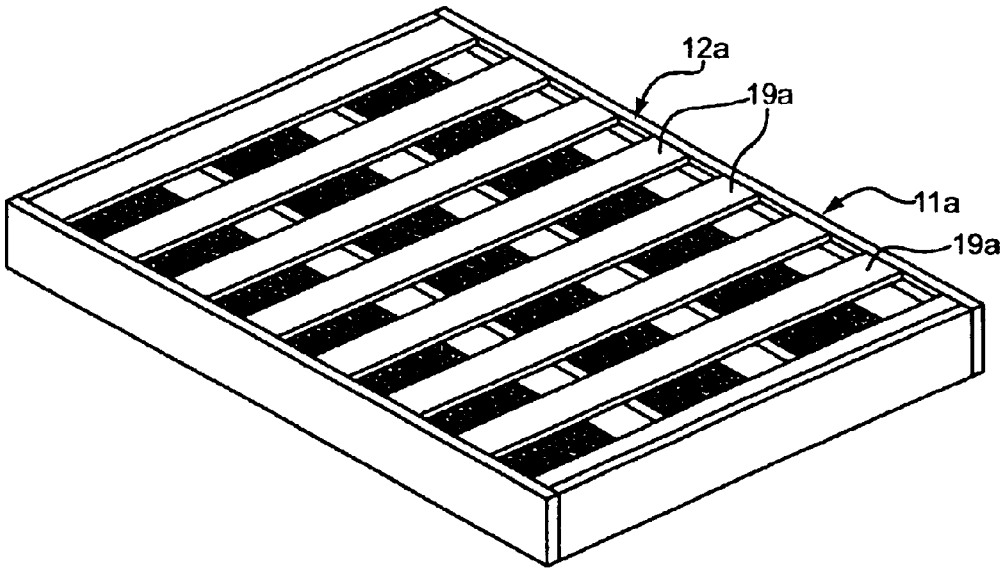

Referring now to FIG. 2A, the lattice means 12 is operable to support the cross slats 19 in downwardly spaced relation relative to the upper edge of the bed frame 11, while in the modification of FIG. 2B, the lattice 12A is operable to support the cross slats 19A adjacent the upper edge of the bed frame 11A.

As shown in perspective view FIG. 3A and detailed view 3B, it will be seen that the cross slat 29 is supported intermediate ends by the vertically oriented support slats 23 that define the air insulation chambers 25. In this embodiment, the ends of the cross slats 29 are supported by means of slots S that are provided in the frame wall 21*a*, which slots receive the corresponding ends of the cross slats 29 respectively. In the modification of FIG. 3C, the cross slats 39 of the lattice 32 are supported by support slats 33 and are connected by support bars B that extend transversely of the cross slats and are connected to the lower surfaces of the ends thereof. The support bars B in turn are supported on projections P that extend inwardly from the adjacent sides of the frame walls 31*a*.

Figure 4A:
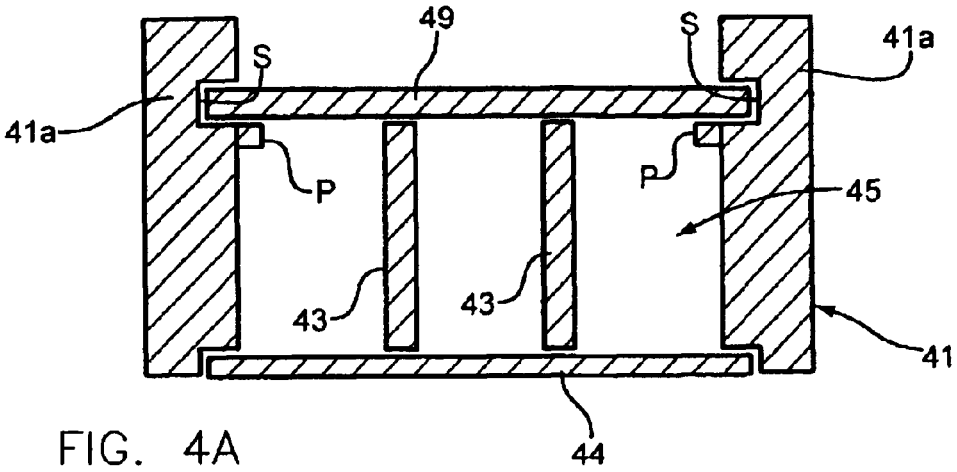
FIG. 4A, FIG. 4B, and FIG. 4C, are sectional views illustrating three means for supporting the ends of the cross slats when in the downwardly spaced relation relative to the upper edge of the bed frame.
Figure 4B:
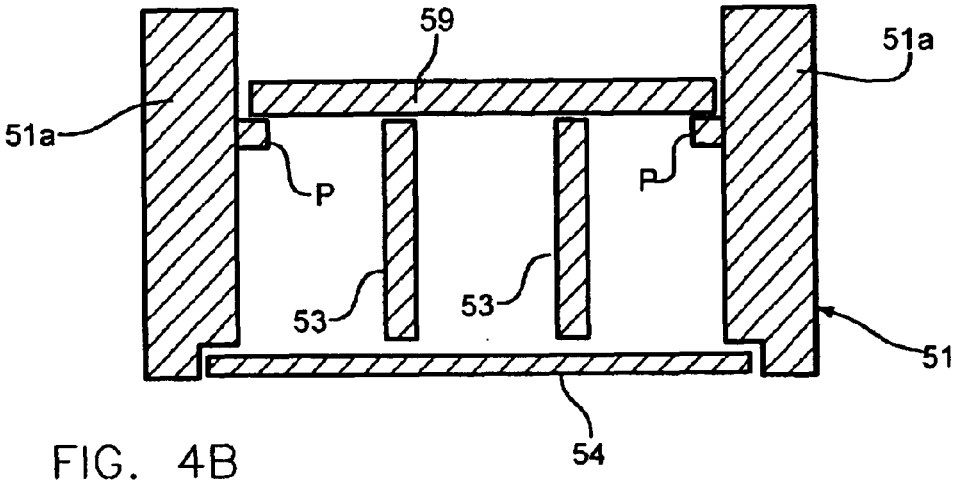
Figure 4C:
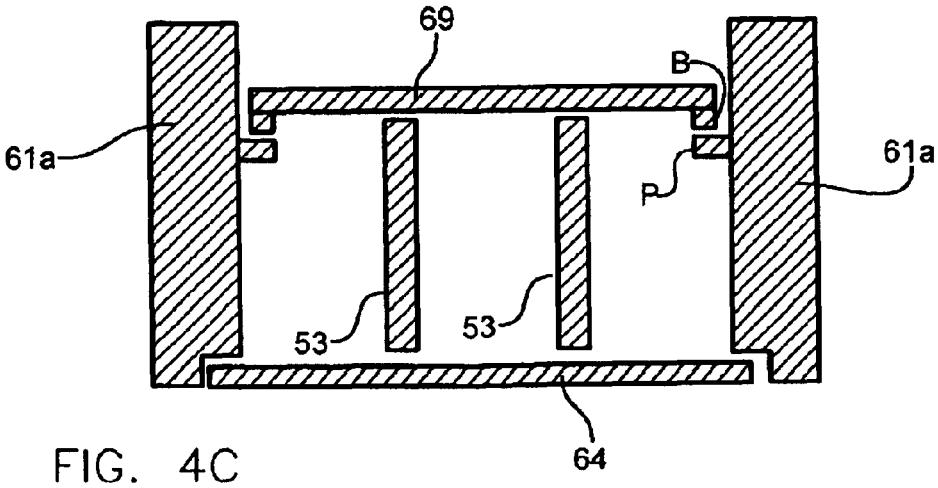

As illustrated in FIG. 4A, the cross slats 49 are supported by vertically oriented support slats 43 arranged above the horizontal bottom wall 44 and in downwardly spaced relation relative to the upper edges of the bed frame 41 by means of slots S that are contained in the adjacent faces of the frame side walls 41*a*, respectively. Inwardly directed projections P may be provided adjacent the lower surfaces of the slots. In the modification of FIG. 4B, the cross slats 59 are supported at their ends by the inwardly directed projections P on the frame walls 51*a* of the bed frame 51, the intermediate portions of the cross slats being supported by the vertically oriented support slats 53 arranged above the horizontal bottom wall 54. In the modification of FIG. 4C, which corresponds generally with the illustration of FIG. 3C, the cross slats 69 are connected at their ends by support bars B that in turn are supported by the inwardly directed projections P on the frame walls 61*a* and by the vertically oriented support slats 53 arranged above the horizontal bottom wall 64.

Figure 5A:
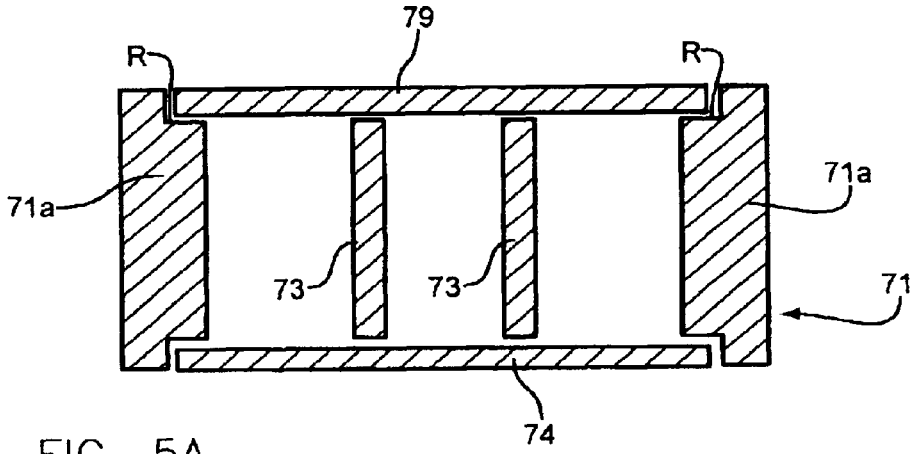
FIGS. 5A and 5B are sectional views illustrating two means for respectively supporting the ends of the cross slats when they are in their uppermost positions adjacent to the edges of the bed frames.
Figure 5B:
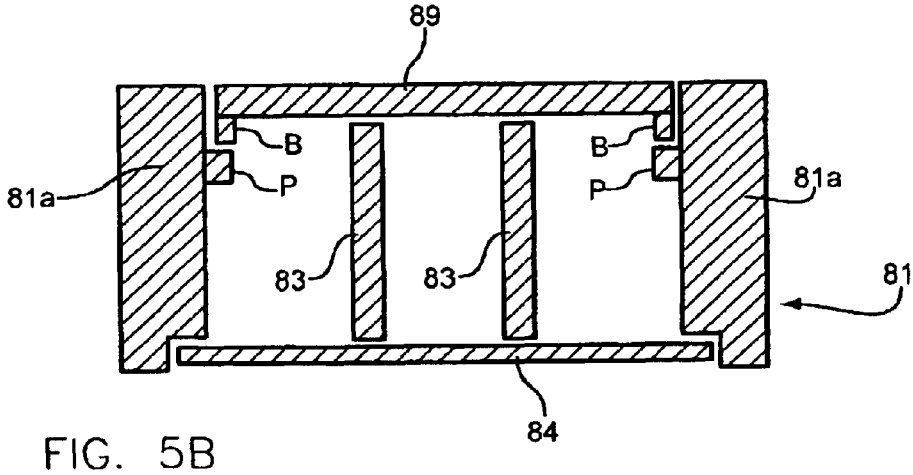

Referring to FIG. 5A, the cross slats 79 are supported by the horizontal vertically oriented support slats 73 arranged above the horizontal bottom wall 74. The upper edge portions of the opposed walls 71*a* of the frame 71 contain recesses R that support the adjacent ends of the cross slats 79. In the modification of FIG. 5B, the support slats 83 are arranged above the horizontal bottom wall 84 and are parallel with and spaced between the opposed walls 81*a* of the frame 81. The ends of the cross slats 89 are connected with transverse support bars B which in turn are supported by the inwardly directed projections P on the opposed frame walls 81*a*.

Figure 6A:
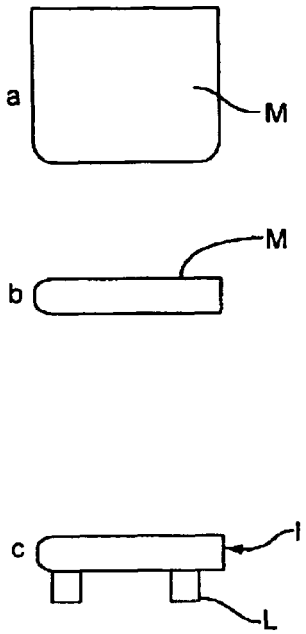
FIGS. 6A and 6B are diagrammatic exploded illustrations illustrating different types of bed frames and the mattresses supported thereby.
Figure 6B:
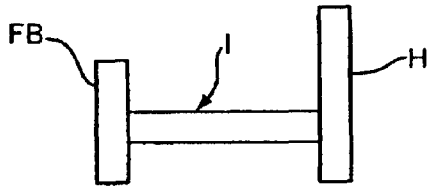

As illustrated in FIG. 6A(c) the bed frame 1 is provided with legs L for supporting the mattress M shown in top plan and side views in FIGS. 6A(a) and 6A(b), respectively. In FIG. 6B(c), the bed frame 1 is provided with a headboard H and a footboard FB for supporting the mattress M shown in the top plan and side views of FIGS. 6B(a) and 6B(c), respectively.

Figure 6C:
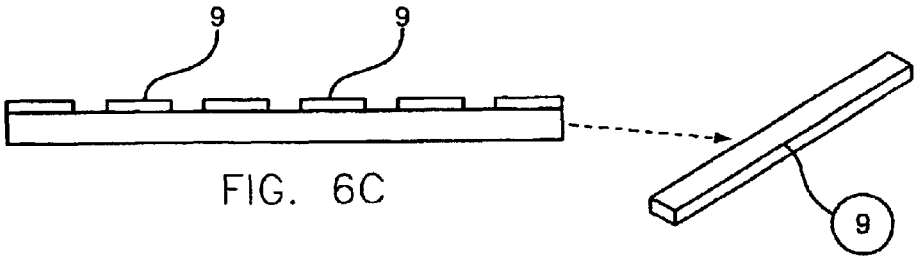
FIGS. 6C and 6D illustrate two different types of cross slats for use in the lattices of bed frames.
Figure 6D:
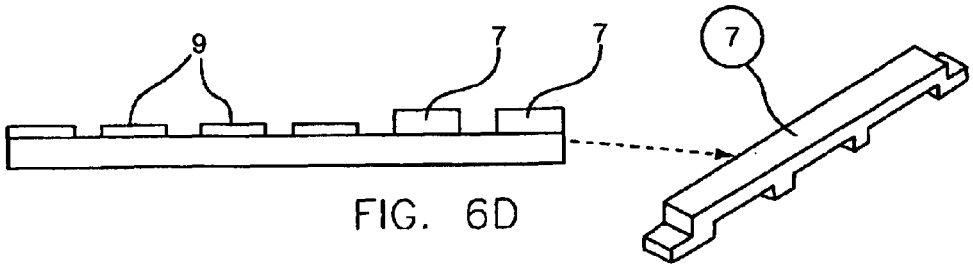

Referring to FIGS. 6C and 6D, the embodiment of FIG. 6C includes a plurality of cross slats 9 each having a uniform thickness. In the modification of FIG. 6D, certain of the cross slats 7 have a greater thickness, whereby corresponding portions of the mattress have a higher elevation than others, as desired by the sleeper. The cross slats 7 have a tooth-shaped configuration, thereby to afford a certain degree of flexibility to the component.

Figure 7:
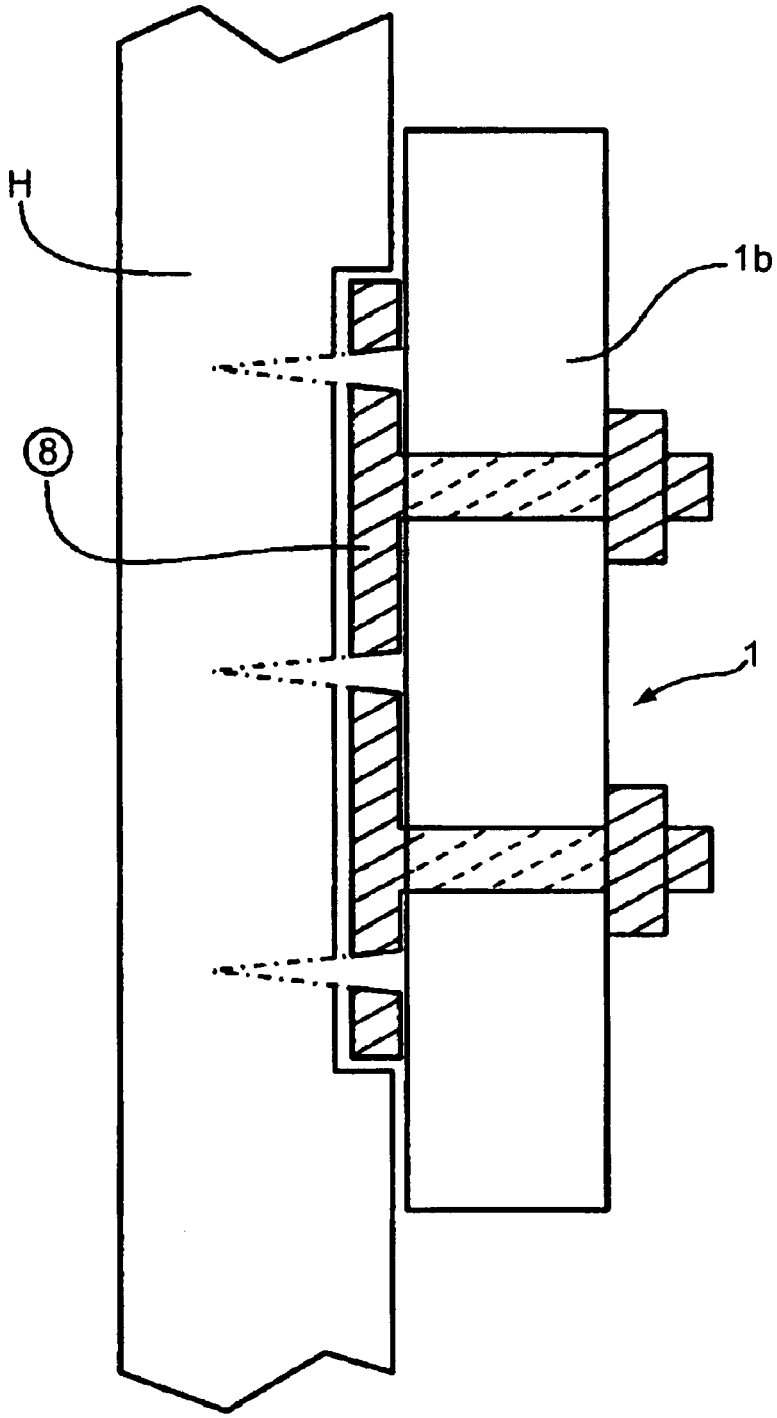
FIG. 7 is a sectional view illustrating the metal bracket means for connecting a headboard to the frame.

FIG. 7 illustrates a metal bracket 8 which is used for connecting the end wall 1*b* of the frame 1 to the headboard H. Thus, the bracket 8 is nailed within a recess contained in the headboard H and includes bolts that extend through corresponding through bores contained in the end wall 1*b*, thereby to bolt the headboard to the frame.

Figure 8A:
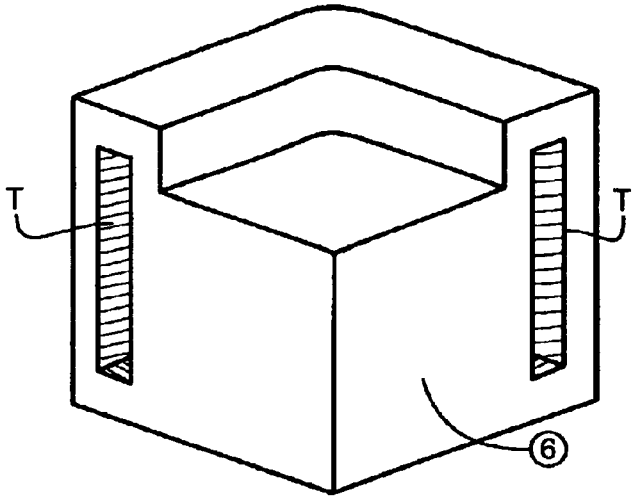
FIG. 8A is a front prospective view of a frame comer member.
Figure 8B:
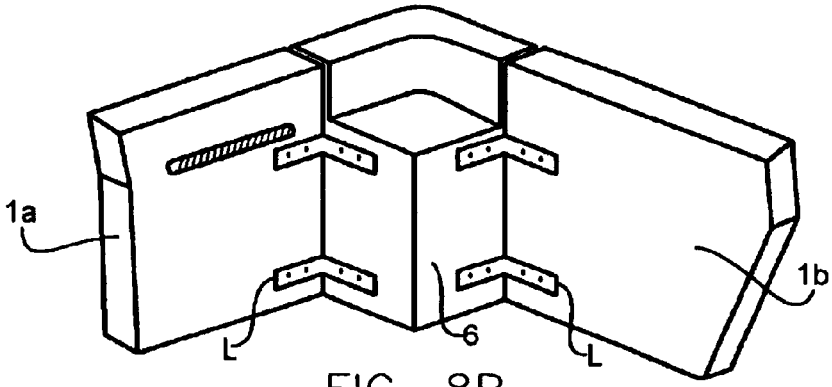
FIG. 8B illustrates the manner of connection of the comer member between two adjacent walls of the frame.
Figure 8C:
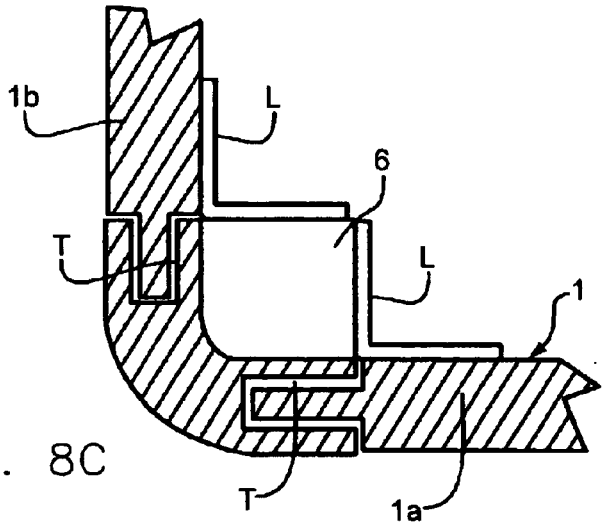
FIG. 8C is a sectional view illustrating the means for connecting the frame walls to the comer member.
Figure 9A:
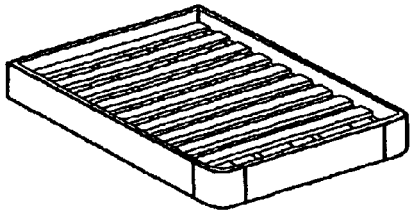
FIGS. 9A–9F illustrate various frame and headboard arrangements.
Figure 9B:
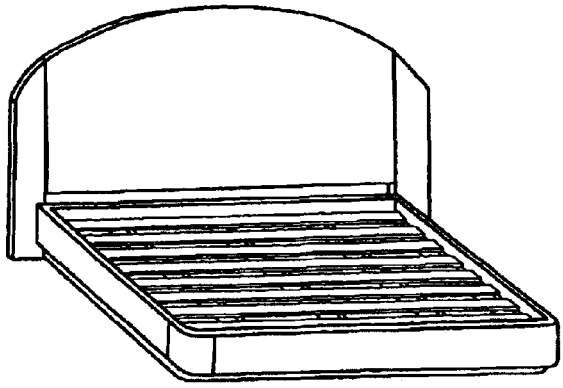
Figure 9C:
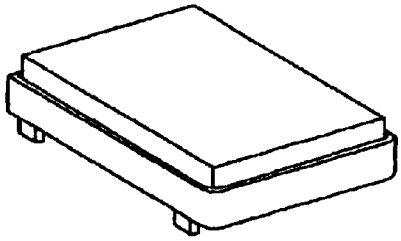
Figure 9D:
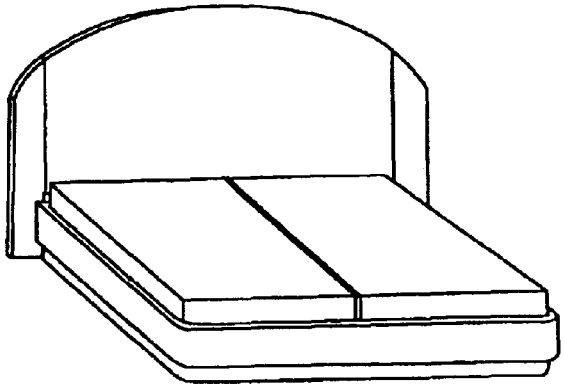
Figure 9E:
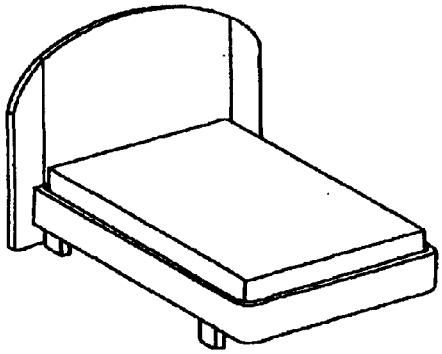
Figure 9F:
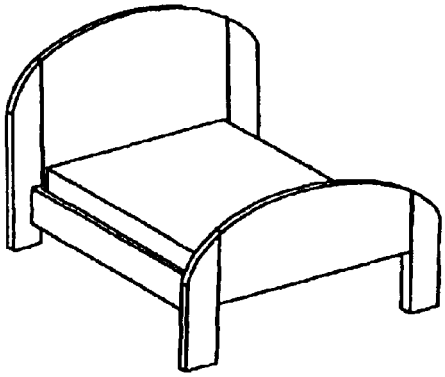

Referring to FIG. 8A, the corner member 6 includes a tenon slot T for receiving the mortise at the end of the corresponding frame wall 1*a*, 1*b*, thereby to connect the comer section to the other walls shown in FIG. 8C. Conventional L-shaped brackets L may be provided for strengthening the connection between the comer section 6 and the frame walls 1*a* and 1*b* as shown in FIG. 8B.

FIGS. 9A–9F, illustrate various bed arrangements that may be obtained using the bed frames of the present invention.

While in accordance with the provisions of the Patent Statutes the preferred forms and embodiments of the invention have been illustrated and described, it will be apparent to those skilled in the art that various changes may be made without deviating from the inventive concepts set forth above.

I claim:

1. A bed frame for supporting a mattress, comprising:

(a) a rigid horizontal rectangular frame (1) including opposed pairs of parallel spaced vertically oriented longitudinal side (1*a*) and transverse end (1*b*) walls, respectively;

(b) a planar wooden bottom wall (4) connected with the bottom of said frame to define an open-topped enclosed space;

(c) a lattice (2) cooperating with said wooden bottom wall to define in said enclosed space a plurality of insulting air chambers (5), said lattice comprising:

(1) a plurality of parallel spaced horizontally-arranged vertically oriented support slats (3) arranged in said enclosed space normal to and extending between a first parallel pair of said frame walls; and (2) a plurality of parallel spaced horizontally arranged horizontally oriented cross slats (9) extending transversely above said support slats in a direction normal to a second pair of frame walls, the intermediate portions of said cross slats being supported by said support slats; and (d) slat end supports on said second pair of frame walls supporting the adjacent ends of said cross slats, respectively.

2. A bed frame as defined in claim 1, wherein said frame, said support slats, and said cross slats are each formed of wood.

3. A bed frame as defined in claim 2, and further including a wooden headboard (H), and metal bracket means (8) connecting said frame end wall with said headboard.

4. A bed frame as defined in claim 1, wherein said support slats (3) extend parallel with said side walls, and said cross slats extend parallel with said end walls.

5. A bed frame as defined in claim 1, wherein said support slats 3 extend parallel with said end walls, and said cross slats 9 extend parallel with said side walls.

6. A bed frame as defined in claim 1, wherein said cross slats are supported in downwardly spaced relation relative to an upper edge of said frame.

7. A bed frame as defined in claim 1, wherein said cross slats are supported adjacent an upper edge of said frame.

8. A bed frame as defined in claim 1, wherein said slat end supports comprise a plurality of spaced slots (S) contained in said second frame walls, said slats receiving the associated ends of said cross slats, respectively.

9. A bed frame as defined in claim 1, wherein said slat end supports comprise a plurality of projections (P) that extend inwardly from adjacent faces of said second pair of frame walls, respectively.

10. A bed frame as defined in claim 9, and further comprising a pair of support bars (B) extending transversely across, and connected below, the respective ends of said cross slats, respectively, said support bars being supported by the corresponding ones of said projections, respectively.

11. A bed frame as defined in claim 1, wherein at least some of said cross slats (7, 9) have different thicknesses, thereby to support different portions of the mattress at different heights relative to said frame.

12. A bed frame as defined in claim 1, and further comprising four externally rounded comer sections (6) arranged at the corners of said frame between the associated side and end walls, respectively, and mortise and tenon joints connecting said side and end walls with said comer sections, respectively.

* * * * *